US007351031B2

(12) United States Patent
Horng et al.

(10) Patent No.: US 7,351,031 B2
(45) Date of Patent: Apr. 1, 2008

(54) CENTRIFUGAL BLOWER

(75) Inventors: Alex Horng, Kaohsiung (TW); Mei-Chih Fang, Kaohsiung (TW); Yu-Yuan Lu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 548 days.

(21) Appl. No.: 10/976,904

(22) Filed: Nov. 1, 2004

(65) Prior Publication Data

US 2006/0093499 A1 May 4, 2006

(51) Int. Cl.
*F04D 29/42* (2006.01)

(52) U.S. Cl. ..... 415/206; 416/187

(58) Field of Classification Search ..... 415/204, 415/206; 416/175, 186 R, 187, 203
See application file for complete search history.

(56) References Cited

U.S. PATENT DOCUMENTS 902,533 A * 10/1908 Hubbard ..... 415/199.6
1,105,967 A * 8/1914 Davidson ..... 415/211.1
6,039,539 A * 3/2000 Berg ..... 416/186 R
7,008,189 B2 * 3/2006 Jarrah et al. ..... 416/175
7,108,482 B2 * 9/2006 Chapman ..... 416/185
2006/0051203 A1 * 3/2006 Lee et al. ..... 415/204

* cited by examiner

*Primary Examiner*—Edward K. Look
*Assistant Examiner*—Nathan Wiehe
(74) *Attorney, Agent, or Firm*—Bacon & Thomas, PLLC

(57) ABSTRACT

A centrifugal blower includes a housing, an impeller, and a guiding cover. The housing includes a compartment delimited by an annular wall. A radial air inlet is defined in the annular wall and communicated with the compartment. The compartment includes an axial opening. The impeller is rotatably mounted in the compartment and includes a hub and a plurality of blades. The guiding cover is mounted on top edges of the blades and includes an axial air inlet in a central portion thereof. The guiding cover covers the axial opening of the compartment without in contact with the housing. The blades and the guiding cover turn synchronously when the impeller turns. Airflow is driven by the blades and guided by the guiding cover and exits the housing via the radial air outlet.

9 Claims, 6 Drawing Sheets

CENTRIFUGAL BLOWER

BACKGROUND OF THE INVENTION

1. Field of the Invention

The present invention relates to a centrifugal blower. In particular, the present invention relates to a centrifugal blower with a simplified structure to allow simple assembly.

2. Description of Related Art

FIG. 1 of the drawings illustrates a conventional centrifugal blower comprising a housing 1, a cover 2, and an impeller 3. The housing 1 includes a compartment 11 and a radial air outlet 12. The cover 2 is mounted on the housing 1 and includes an axial air inlet 21. The impeller 3 is rotatably mounted in the compartment 11 of the housing 1 and includes a hub 31, a supporting plate 32 extending outward from the hub 31, and a plurality of blades 33 fixed on the supporting plate 32. In operation, the blades 33 suck axial airflow via the axial air inlet 21 of the cover 2 when the impeller 3 turns. Then, the axial airflow is driven by the blades 33 to exit the housing 1 via the radial air outlet 12 for dissipating an object (such as a fin).

In assembly, the impeller 3 is firstly mounted in the compartment 11 of the housing 1. Then, the housing 1 and the cover 2 are engaged together by a suitable method (such as by engaging members, screwing, welding, or bonding). The assembling procedure is troublesome. Further, both of the housing 1 and the cover 2 have a complicated structure for engaging with each other, rendering it difficult to cut the cost for manufacturing the molds for the housing 1 and the cover 2 and to minimization of the centrifugal blower. Further, the cover 2 limits the axial height of the blades 33 of the impeller 3. Further, since the lower edge of the axial air inlet 21 of the cover 2 is stationary while the upper edges of the blades 33 are rotating, turbulent and noise occur easily in an area therebetween. Further, the air in the compartment 11, when accumulated to a certain amount, leaks to the environment via the axial air inlet 21, failing to provide the expected pressure-boosting effect.

OBJECTS OF THE INVENTION

An object of the present invention is to provide a centrifugal blower that can be assembled through a simplified assembling procedure.

Another object of the present invention is to provide a centrifugal blower that has increased amount of inlet air.

A further object of the present invention is to provide a centrifugal blower that has lowered noise during air intake.

Still another object of the present invention is to provide a centrifugal blower with improved pressure-boosting effect for outputted airflow.

SUMMARY OF THE INVENTION

In accordance with an aspect of the present invention, a centrifugal blower comprises a housing, an impeller, and a guiding cover. The housing includes a compartment delimited by an annular wall. A radial air inlet is defined in the annular wall and communicated with the compartment. The compartment includes an axial opening. The impeller is rotatably mounted in the compartment and includes a hub and a plurality of blades. The guiding cover is mounted on top edges of the blades and includes an axial air inlet in a central portion thereof. The guiding cover covers the axial opening of the compartment without being in contact with the housing. The blades and the guiding cover turn synchronously when the impeller turns. Airflow is driven by the blades and guided by the guiding cover and exits the housing via the radial air outlet.

In an embodiment of the invention, the impeller further includes a supporting plate extends from the hub, and the blades are fixed on the supporting plate and annularly spaced from one another. The guiding cover and the supporting plate define a dynamic guiding passageway for guiding the airflow.

In another embodiment of the invention, each blade includes a top side inclining radially outward and downward, forming a slanted side to which the guiding cover is attached.

The guiding cover includes an outer end extending radially outward. The outer end of the guiding cover covers a top of the axial opening of the compartment without being in contact with the housing, thereby maintaining wind pressure in the compartment.

In a further embodiment of the invention, the housing further includes a plurality of radial auxiliary air inlets in the annular wall. The radial auxiliary air inlets are adjacent to the radial air outlet and in an air-blowing starting section. The guiding plate includes an air inlet tube extending upward from the axial air inlet. The air inlet tube includes a plurality of guiding plates extending from an inner periphery of the air inlet tube.

Other objects, advantages and novel features of this invention will become more apparent from the following detailed description when taken in conjunction with the accompanying drawings.

DETAILED DESCRIPTION OF THE PREFERRED EMBODIMENTS

Figure 2:
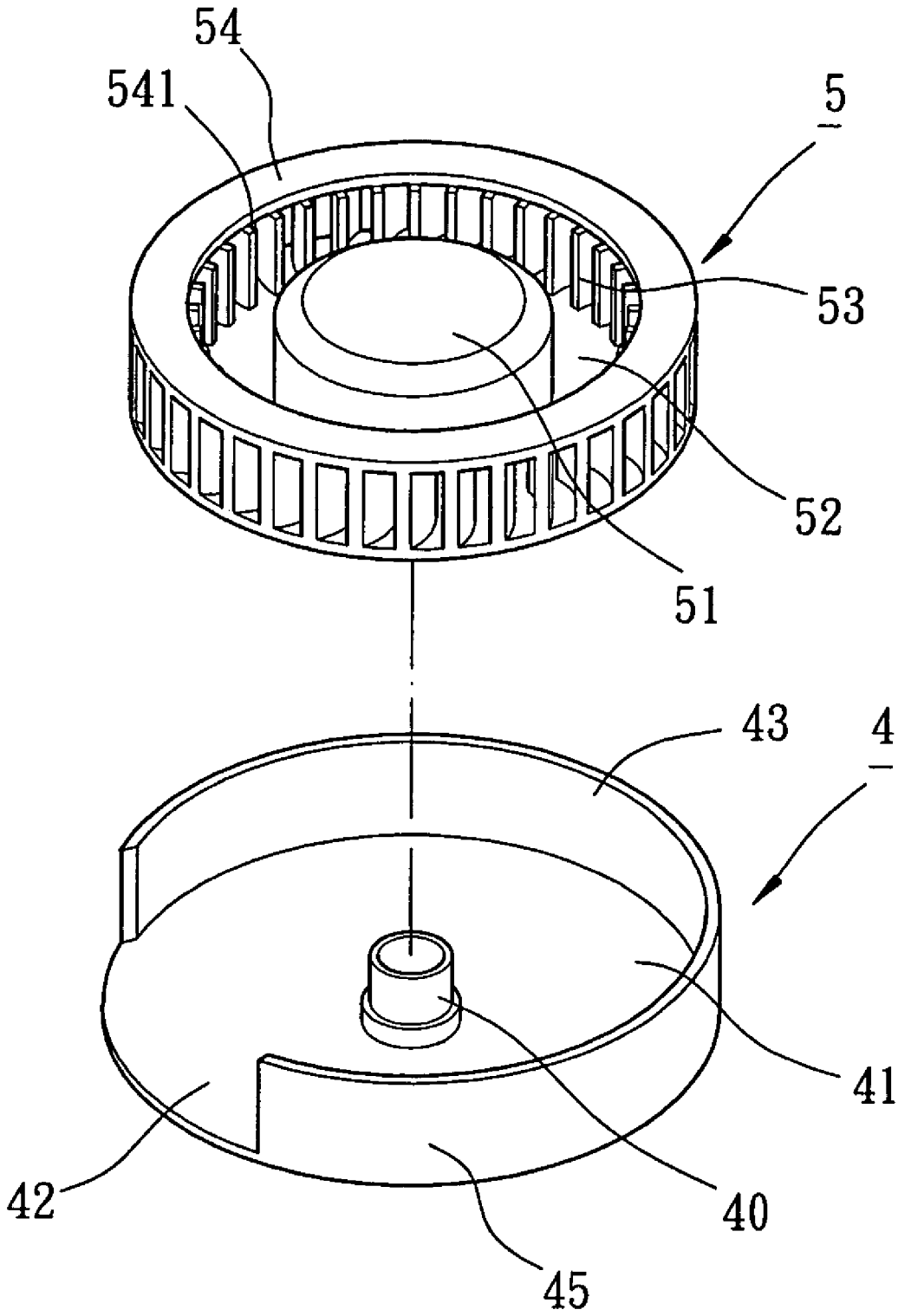
FIG. 2 is an exploded perspective view of a first embodiment of a centrifugal blower in accordance with the present invention.
Figure 3:
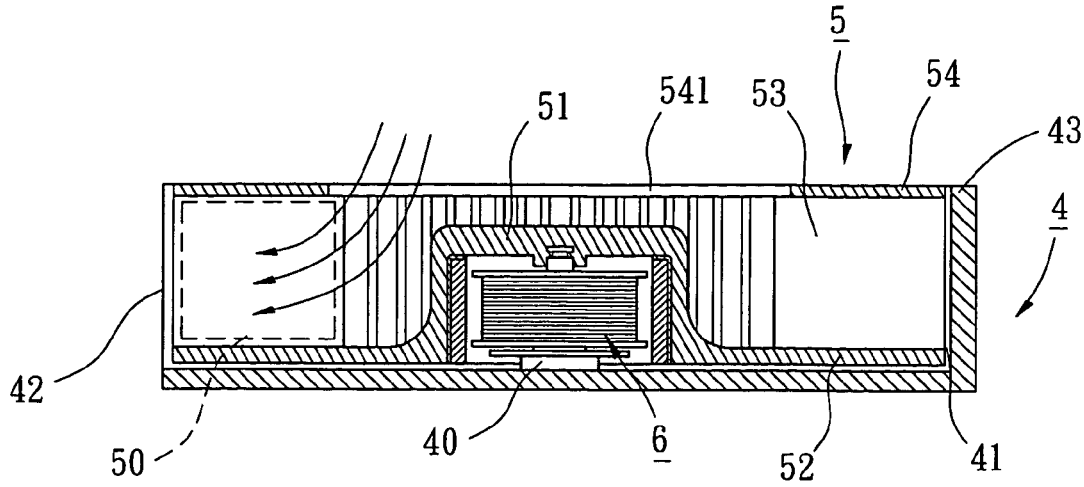
FIG. 3 is a sectional view of a sectional view of the first embodiment of the centrifugal blower in accordance with the present invention after assembly with a motor.

Referring to FIGS. 2 and 3, a first embodiment of a centrifugal blower in accordance with the present invention comprises a housing 4 and an impeller 5. The housing 4 includes a compartment 41 delimited by an annular wall 45, a radial air outlet 42 delimited in the annular wall 45 and communicated with the compartment 41, and an axial tube 40 mounted in a central portion of the compartment 41. A motor 6 is engaged with the axial tube 40, and the impeller 5 is mounted around and driven by the motor 6. The compartment 41 is communicated with outside via the radial air outlet 42 and an axial opening 43 of the compartment 41.

The impeller 5 includes a hub 51, a supporting plate 52 extending radially outward from the hub 51, a plurality of blades 53, and a guiding cover 54. The blades 53 are fixed on the supporting plate 52 and annularly spaced from one another. The guiding cover 54 is fixed on top edges of the blades 53 and rotates together with the impeller 5. An axial air inlet 541 is defined in a central area of the guiding cover 54. Thus, the guiding cover 54 covers a top of the housing 4 without being in contact with the housing 4. A dynamic guiding passageway 50 is defined between the guiding cover 54 and the supporting plate 52.

As illustrated in FIG. 3, in assembly, the motor 6 is mounted on the axial tube 40 in the compartment 41, and the impeller 5 is then mounted on the motor 6 to finish the assembly. The assembling procedure is relatively simple. The housing 4 has a simple structure. Thus, the cost for manufacturing the mold for the housing 4 and for assembly is relatively low.

After assembly, the guiding cover 54 is rotatable together with the impeller 5 and covers a top of the axial opening 43 of the compartment 41 without being in contact with the housing 4. When the impeller 5 is driven to turn by the motor 6, the guiding cover 54 turns together with the impeller 5. Axial airflow is sucked into the compartment 41 of the housing 4 by the blades 53 via the axial air inlet 541 of the guiding cover 54. Next, the axial airflow turns into radial airflow under guidance by the blades 53 and the guiding cover 54 and enters the dynamic guiding passageway 50. At this time, the blades 53 keep driving the airflow to move radially outward whereas the dynamic guiding passageway 50 provides a synchronous dynamic air guiding effect. The dynamic air guiding means the guiding cover 50 and the dynamic guiding passageway 50 rotate synchronously with the impeller 5 for guiding the airflow. Next, the radial airflow exit the housing 4 via the radial air outlet 42 for dissipating heat for an object such as a fin.

Figure 1:
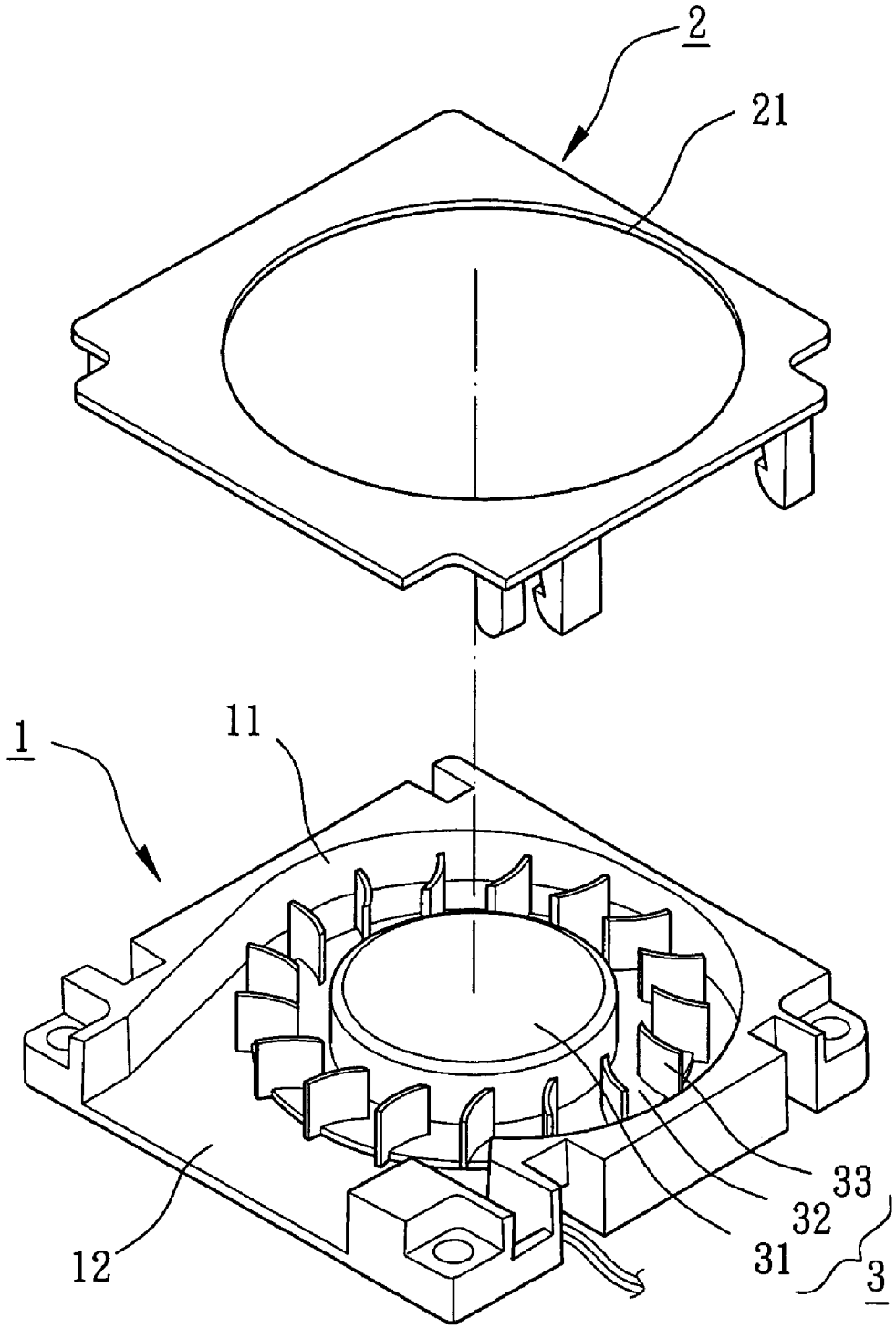
FIG. 1 PRIOR ART
FIG. 1 is an exploded perspective view of a conventional centrifugal blower.

Still referring to FIG. 3, during guiding of the airflow, since the guiding cover 54 and the axial air inlet 541 rotate synchronously with the blades 53 and since the axial air inlet 541 sucks air while rotating, the turbulent or noise generated during air intake is lowered. Further, the conventional cover required for a conventional housing (see FIG. 1) is no longer required. As a result, the blades 53 may extend upward to a position above the axial opening 43 of the compartment 41 and directly in contact with the guiding cover 54. Thus, the axial height of the blades 53 in accordance with the present invention is higher than that of the conventional design. The overall blowing area of the blades is increased, improving the blowing effect of the impeller 5.

Figure 4:
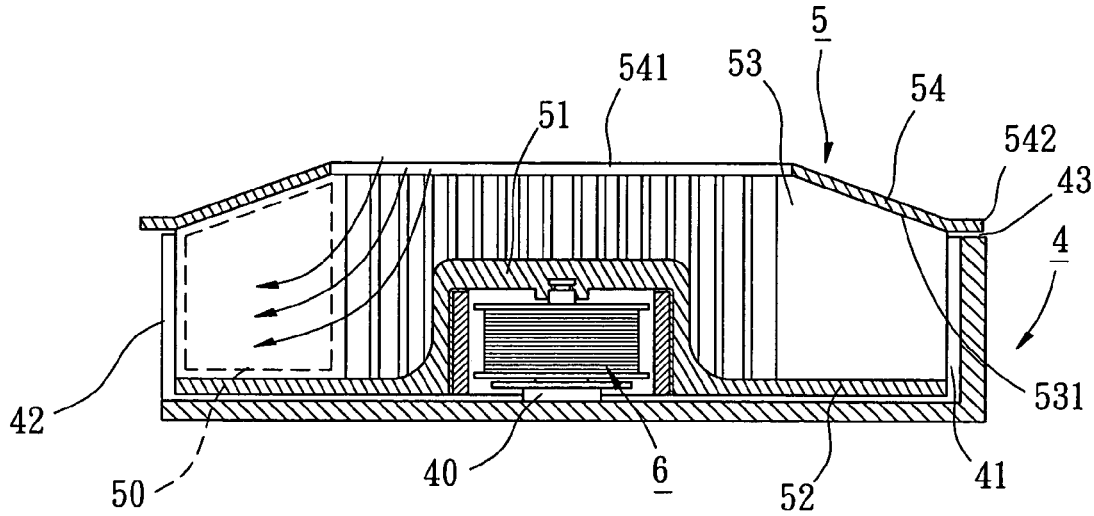
FIG. 4 is a sectional view similar to FIG. 3, illustrating a second embodiment of the centrifugal blower in accordance with the present invention.

FIG. 4 illustrates a second embodiment of the invention. In this embodiment, a top side of each blade 53 inclines radially outward and downward, forming a slanted face 531 to which the guiding cover 54 is attached. Thus, the dynamic guiding passageway 50 delimited by the guiding cover 54 and the supporting plate 52 tapers radially outward, providing a dynamic air guiding effect while providing a dynamic pressure-boosting effect (i.e., the guiding cover 54 and the dynamic guiding passageway 50 rotate synchronously with the impeller 5 for increasing the wind pressure). An outer edge 542 of the guiding cover 54 extends radially outward to a position exceeding the maximum diameter of the impeller 53, allowing the guiding cover 54 to cover the top of the axial opening 43 of the compartment 41 without being in contact with the housing 4. During rotation of the impeller 5, the outer edge 542 of the guiding cover 54 covers the top of the axial opening 43 of the compartment 41, reliably preventing leakage of air in the compartment 41 and thus preventing drop of the wind pressure.

Figure 5:
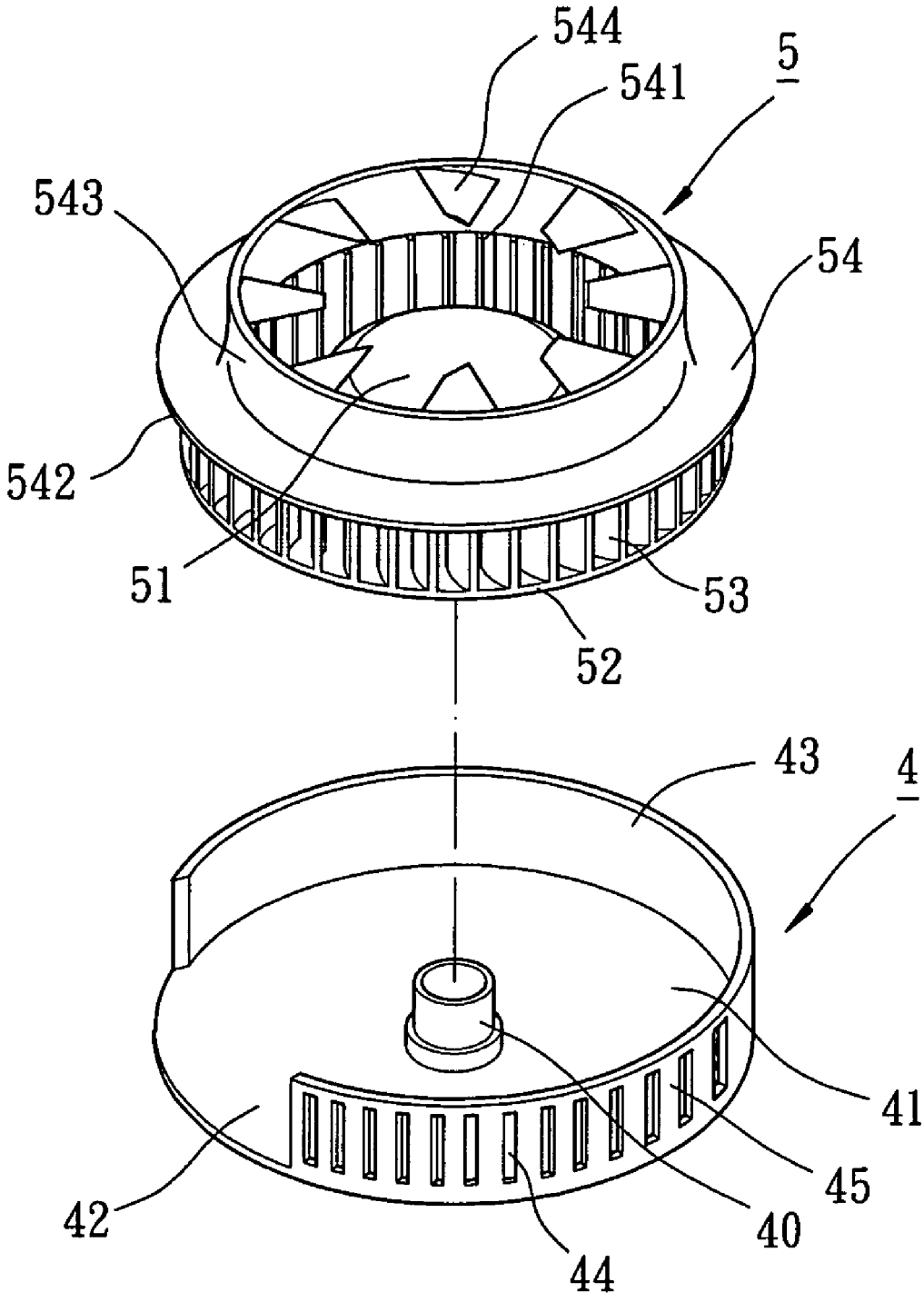
FIG. 5 is an exploded perspective view of a third embodiment of the centrifugal blower in accordance with the present invention.
Figure 6:
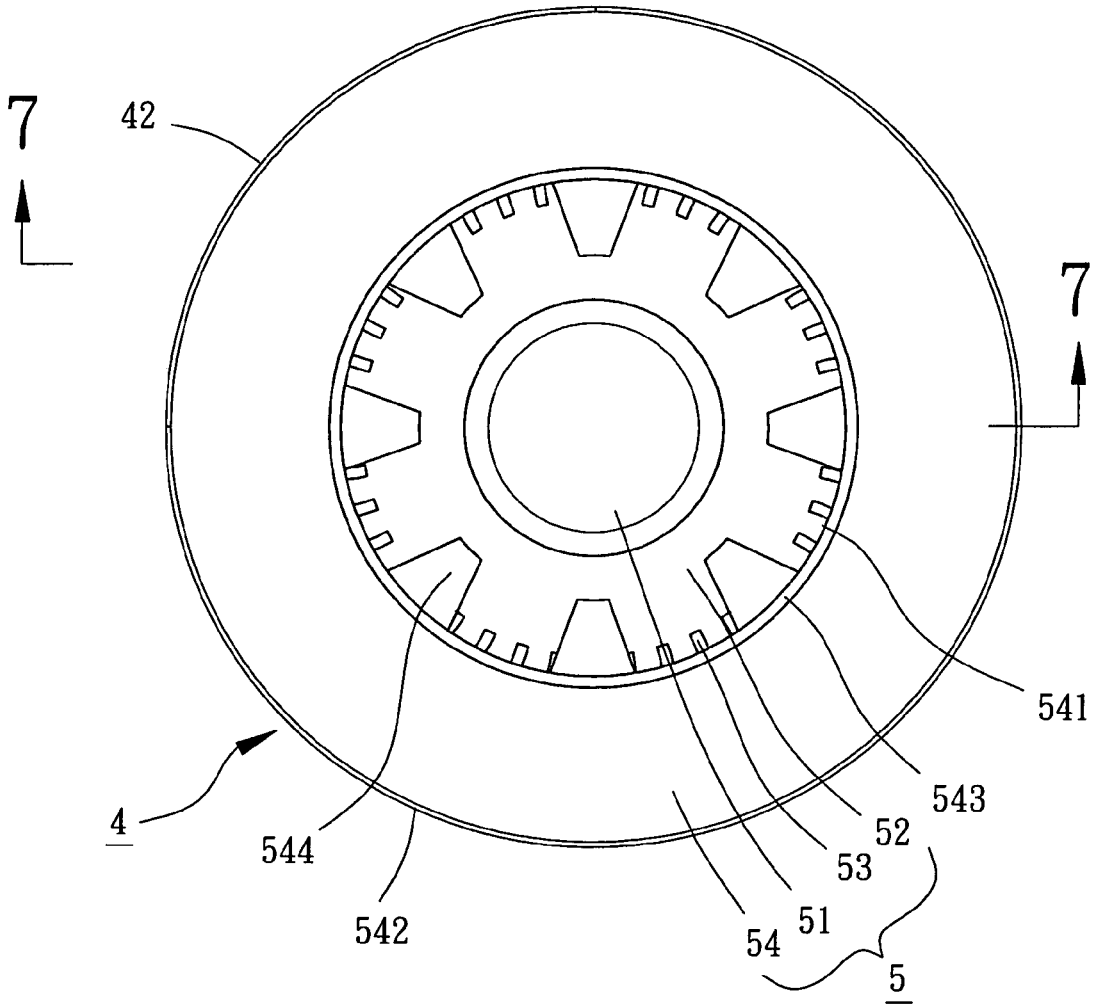
FIG. 6 is a top view of the third embodiment of the centrifugal blower in accordance with the present invention after assembly with a motor.
Figure 7:
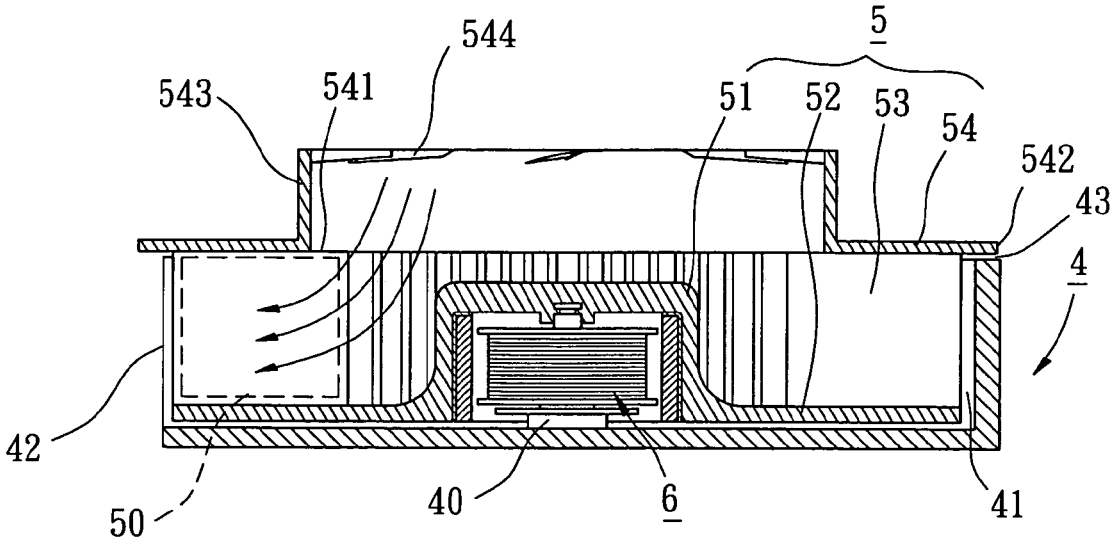
FIG. 7 is a sectional view taken along plane 7-7 in FIG. 6.

FIGS. 5 through 7 illustrate a third embodiment of the invention modified from the first embodiment. In this embodiment, the annular wall 45 delimiting the compartment 41 includes a plurality of radial auxiliary air inlets 41 adjacent to the radial outlet 42. Further, the guiding cover 54 includes an air inlet tube 543 extending upward from the axial air inlet 541. A plurality of equispaced inclined guiding plates 544 extend from an inner periphery of the air inlet tube 543. The radial auxiliary air inlets 41 are located in an air-blowing starting section. Further, each radial auxiliary air inlet 41 has an area that is much smaller 5 than that of the radial air outlet 42. Similarly, the guiding cover 54 of the impeller covers the axial opening 43 of the compartment 41 without being in contact with the housing 4, and the assembly of the impeller 54 and the housing 4 is simplified. The air inlet tube 543 concentrates the incoming axial airflow, prevents leakage of the incoming airflow, and improves the air intake effect of the axial air inlet 541. The guiding plates 544 drive axial airflow into the axial air inlet 541 to improve the overall air intake efficiency and to increases the overall air intake amount. The radial auxiliary air inlets 44 allow use of ambient air surrounding the annular wall 45 and increases the overall air intake amount.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A centrifugal blower comprising:

a housing comprising a compartment delimited by an annular wall, a radial air inlet being defined in the annular wall and communicated with the compartment, the compartment including an axial opening;

an impeller rotatably mounted in the compartment, the impeller including a hub and a plurality of blades; and a guide cover mounted on top edges of the blades, the guiding cover including an axial air inlet in a central portion thereof and an outer end extending radially outward, the guiding cover covering the axial opening of the compartment without in contact with the housing, the outer end of the guiding cover covering a top of the axial opening of the compartment without being in contact with the housing, thereby maintaining wind pressure in the compartment;

the blades and the guiding cover turning synchronously when the impeller turns, airflow being driven by the blades and guided by the guiding cover and exiting the housing via the radial air outlet.

2. The centrifugal blower as claimed in claim 1 wherein the guiding plate includes an air inlet tube extending upward from the axial air inlet.

3. The centrifugal blower as claimed in claim 2 wherein the air inlet tube includes a plurality of guiding plates extending from an inner periphery of the air inlet tube.

4. A centrifugal blower comprising:

a housing comprising a compartment delimited by an annular wall, a radial air inlet and a plurality of radial auxiliary air inlets being defined in the annular wall with the radial air inlet being communicated with the compartment, the compartment including an axial opening;

an impeller rotatably mounted in the compartment, the impeller including a hub and a plurality of blades; and a guiding cover mounted on top edges of the blades, the guiding cover including an axial air inlet in a central portion thereof, the guiding cover covering the axial opening of the compartment without being in contact with the housing;

the blades and the guiding cover turning synchronously when the impeller turns, airflow being driven by the blades and guided by the guiding cover and exiting the housing via the radial air outlet.

5. The centrifugal blower as claimed in claim 4 wherein the radial auxiliary air inlets are adjacent to the radial air outlet and in an air-blowing starting section.

6. The centrifugal blower as claimed in claim 5 wherein the guiding plate includes an air inlet tube extending upward from the axial air inlet.

7. The centrifugal blower as claimed in claim 6 wherein the air inlet tube includes a plurality of guiding plates extending from an inner periphery of the air inlet tube.

8. The centrifugal blower as claimed in claim 4 wherein the guiding plate includes an air inlet tube extending upward from the axial air inlet.

9. The centrifugal blower as claimed in claim 8 wherein the air inlet tube includes a plurality of guiding plates extending from an inner periphery of the air inlet tube.

* * * * *